US010996578B2

(12) United States Patent
Nemoto

(10) Patent No.: US 10,996,578 B2
(45) Date of Patent: May 4, 2021

(54) TONER, IMAGE FORMING APPARATUS, IMAGE FORMING METHOD, AND TONER ACCOMMODATING UNIT

(71) Applicant: Taichi Nemoto, Shizuoka (JP)

(72) Inventor: Taichi Nemoto, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/743,121

(22) Filed: Jan. 15, 2020

(65) Prior Publication Data

US 2020/0233328 A1 Jul. 23, 2020

(30) Foreign Application Priority Data

Jan. 22, 2019 (JP) ..... JP2019-008789

(51) Int. Cl.

| | |
|---|---|
| ***G03G 9/08*** | (2006.01) |
| ***G03G 9/087*** | (2006.01) |
| ***G03G 9/09*** | (2006.01) |
| ***G03G 15/08*** | (2006.01) |

(52) U.S. Cl.

CPC ..... *G03G 9/08755* (2013.01); *G03G 9/0821* (2013.01); *G03G 9/0904* (2013.01); *G03G 15/0865* (2013.01)

(58) Field of Classification Search

CPC ..... G03G 9/0821
USPC ..... 430/111.4
See application file for complete search history.

(56) References Cited

U.S. PATENT DOCUMENTS

| | | | |
|---|---|---|---|
| 2017/0336726 | A1 | 11/2017 | Hasegawa et al. |
| 2018/0267417 | A1 | 9/2018 | Mizoguchi et al. |
| 2019/0227449 | A1 | 7/2019 | Nemoto et al. |
| 2019/0235405 | A1 | 8/2019 | Masuda et al. |
| 2020/0012206 | A1 | 1/2020 | Takebayashi et al. |

FOREIGN PATENT DOCUMENTS

| | | | |
|---|---|---|---|
| EP | 0 792 295 | A1 | 9/1997 |
| JP | 2005-99581 | A | 4/2005 |
| JP | 2013-142877 | | 7/2013 |
| JP | 2015-092212 | | 5/2015 |
| JP | 2017-62352 | A | 3/2017 |
| JP | 2017-211647 | | 11/2017 |
| WO | WO 96/15159 | A1 | 5/1996 |

OTHER PUBLICATIONS

Extended European Search Report dated May 20, 2020, in Patent Application No. 20151490.8, 8 pages.

*Primary Examiner* — Mark A Chapman
(74) *Attorney, Agent, or Firm* — Oblon, McClelland, Maier & Neustadt, L.L.P.

(57) ABSTRACT

A toner is provided. The toner comprises a binder resin, a colorant, and a release agent. The toner satisfies the following relations (1) and (2):

$$3.0\times10^2 \leq G'(50)/G'(80) \quad (1)$$

$$T(10^7) \geq 75 \text{ degrees C.} \quad (2)$$

where G'(50) represents a storage elastic modulus at 50 degrees C., G'(80) represents the storage elastic modulus at 80 degrees C., and T($10^7$) represents a temperature at which the storage elastic modulus is $10^7$ Pa or higher during a temperature fall from 100 degrees C. to 30 degrees C., in a measurement of dynamic viscoelasticity of the toner.

8 Claims, 4 Drawing Sheets

TONER, IMAGE FORMING APPARATUS, IMAGE FORMING METHOD, AND TONER ACCOMMODATING UNIT

CROSS-REFERENCE TO RELATED APPLICATIONS

This patent application is based on and claims priority pursuant to 35 U.S.C. § 119(a) to Japanese Patent Application No. 2019-008789, filed on Jan. 22, 2019, in the Japan Patent Office, the entire disclosure of which is hereby incorporated by reference herein.

BACKGROUND

Technical Field

The present disclosure relates to a toner, an image forming apparatus, an image forming method, and a toner accommodating unit.

Description of the Related Art

In recent years, it has been required in the market to improve low-temperature fixability of toner for energy saving. Low-temperature fixability is exhibited when the glass transition temperature of the binder resin is lowered to make the binder resin undergo plastic deformation more easily. However, this results in deterioration of heat-resistant storage stability. In attempting to achieve low-temperature fixability, a large number of toners have been proposed the viscoelasticity of each of which has been controlled by using a crystalline resin and an amorphous resin in combination as binder.

However, if the crystalline resin is exposed at the surface of toner, the toner particles may aggregate due to stress received when stirred in a developing device, resulting in an abnormal image and poor reliability of the toner.

In attempting to effectively prevent the occurrence of trailing-edge offset, density unevenness in a halftone image, and fogging in a high-temperature severe environment, a toner exhibiting specified viscoelasticity in rising the temperature has been proposed. However, nothing has been discussed on the phenomenon called stacking in which the toner fixed on the sheet sticks to another sheet. Stacking may be caused when a crystalline polyester having a low crystallization speed or a large amount of crystalline polyester is introduced into the toner that makes the elastic recovery of the fixed toner slower.

The conventional method of lowering the viscoelasticity of toner by using a crystalline polyester is insufficient for achieving both heat-resistant storage stability and reliability (such as blocking prevention) at the same time.

SUMMARY

In accordance with some embodiments of the present invention, a toner is provided. The toner comprises a binder resin, a colorant, and a release agent. The toner satisfies the following relations (1) and (2):

$$3.0\times10^2 \leq G'(50)/G'(80) \quad (1)$$

$$T(10^7) \geq 75 \text{ degrees C.} \quad (2)$$

where G'(50) represents a storage elastic modulus at 50 degrees C., G'(80) represents the storage elastic modulus at 80 degrees C., and $T(10^7)$ represents a temperature at which the storage elastic modulus is $10^7$ Pa or higher during a temperature fall from 100 degrees C. to 30 degrees C., in a measurement of dynamic viscoelasticity of the toner.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
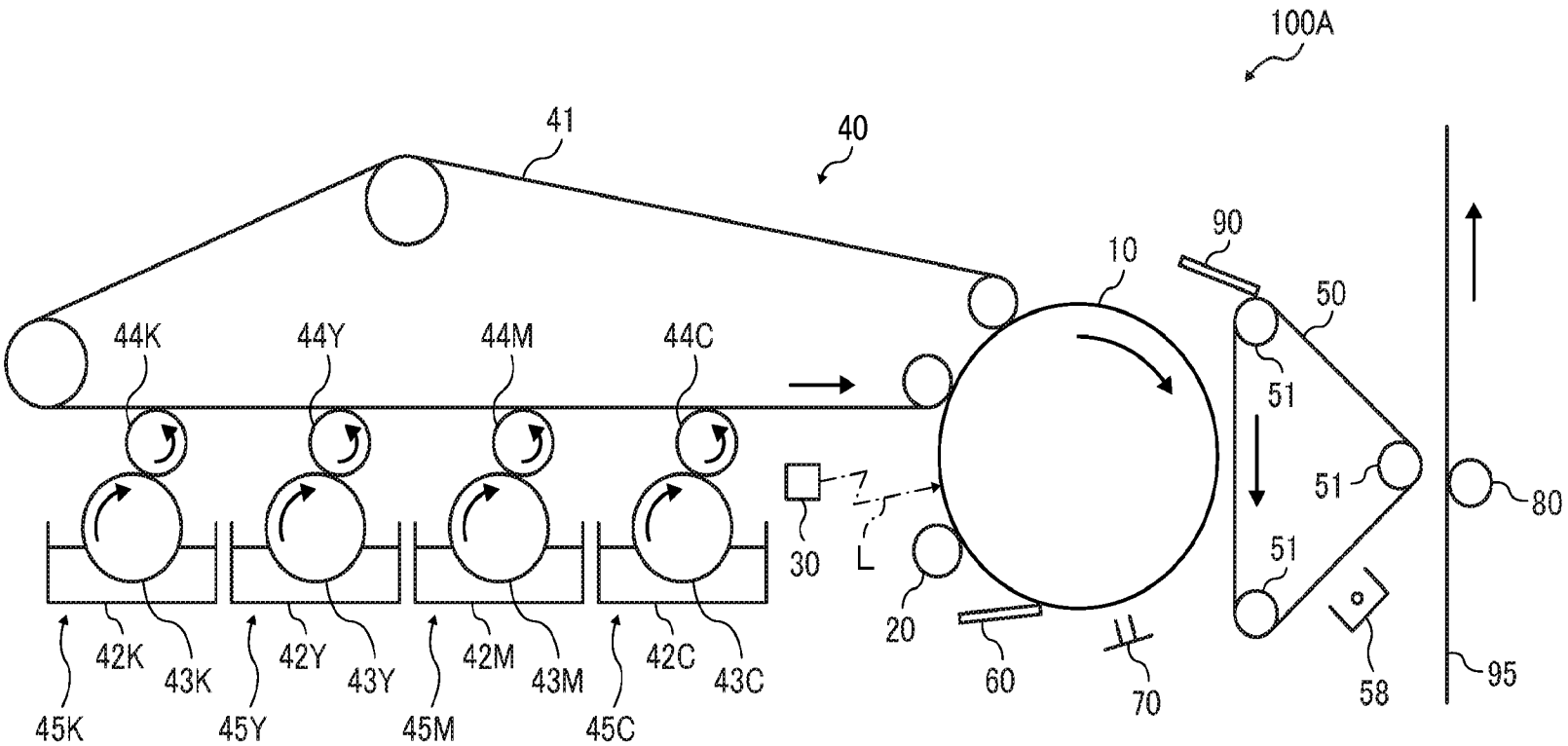
FIG. 1 is a schematic diagram illustrating an image forming apparatus according to an embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

In accordance with some embodiments of the present invention, a toner that achieves both low-temperature fixability and stacking resistance is provided.

Toner

The toner according to an embodiment of the present invention contains a binder resin, a colorant, and a release agent, and may further contain other components, as necessary.

The binder resin may contain a crystalline polyester resin as long as the toner satisfies the following relations (1) and (2). The toner satisfies the following relations (1) and (2) in a measurement of dynamic viscoelasticity of the toner, where G'(50) represents a storage elastic modulus at 50 degrees C., G'(80) represents the storage elastic modulus at 80 degrees C., and $T(10^7)$ represents a temperature at which the storage elastic modulus is $10^7$ Pa or higher during a temperature fall from 100 degrees C. to 30 degrees C.

$$3.0\times10^2 \leq G'(50)/G'(80) \quad (1)$$

$$T(10^7) \geq 75 \text{ degrees C.} \quad (2)$$

To satisfy the above-described relations, it is required that (1) the viscoelasticity of the toner is lowered more easily than that of the conventional toner during a temperature rise and (2) the viscoelasticity of the conventional toner is higher during a temperature fall.

For example, (1) when the molecular weight of the binder resin is reduced to lower the viscoelasticity of the toner during a temperature rise, (2) the viscoelasticity of the conventional toner is also lowered during a temperature fall. Thus, (1) and (2) are in a trade-off relationship.

According to some embodiments of the present invention, the above-described problem can be solved by using a resin having a bond (cross-linking point) capable of reversibly dissociating and rebinding by heat.

Specifically, the bond is dissociated by heat to lower viscosity but is rebound when cooled to improve elasticity, so that both (1) and (2) can be achieved.

The inventors of the present invention have found that a toner designed to have the above-described composition and physical properties is given the following properties and provides high-quality images.

- Sharply-melting property that can achieve both low-temperature fixability and heat-resistant storage stability of the toner at high levels.
- Reducing undesirable phenomena unique to toners containing a crystalline resin, such as cohesion of toner particles in a developing device due to lack of mechanical durability, carrier contamination, in-machine contamination, and deterioration of chargeability and fluidity due to embedment of external additives.

The toner may further contain other components, as necessary, as long as the toner satisfies the following relations (1) and (2) in a measurement of dynamic viscoelasticity of the toner, where G'(50) represents a storage elastic modulus at 50 degrees C., G'(80) represents the storage elastic modulus at 80 degrees C., and $T(10^7)$ represents a temperature at which the storage elastic modulus is $10^7$ Pa or higher during a temperature fall from 100 degrees C. to 30 degrees C.

$$3.0\times10^2 \leq G'(50)/G'(80) \quad (1)$$

$$T(10^7) \geq 75 \text{ degrees C.} \quad (2)$$

Preferably, G'(50)/G'(80) is $3.0\times10^2$ or more, more preferably $6.0\times10^2$ or more, for fixability.

G'(50)/G'(80) may be adjusted to be in the above-described range by, for example, controlling physical properties of the binder resin, more specifically, by adjusting the compatibility of the crystalline polyester with another binder resin comprising an amorphous resin or the melting point or crystallinity of the binder resin. The crystalline polyester is expected to reduce G'(80) by quickly melting upon application of heat while reducing the compatibility with the binder resin in the toner. However, if a large amount of crystalline polyester is used to adjust G'(50)/G'(80) to be in the above-described range, stacking of the sheets may occur immediately after fixing of the toner. It is clear that the amount of crystalline polyester to be used has a limitation.

To prevent the sheets from stacking immediately after fixing of the toner, $T(10^7)$ of the toner is 75 degrees C. or higher, where $T(10^7)$ represents a temperature at which the storage elastic modulus G' is $10^7$ Pa or higher during a temperature fall from 100 degrees C. to 30 degrees C. in a measurement of dynamic viscoelasticity of the toner.

The inventors of the present invention actually measured the temperature of the sheet during printing. As a result, it was about 100 to 120 degrees C. near the nip portion of the fixing device and was approximately 75 degrees C. immediately after the sheet had been ejected from the machine. At that time, the viscoelasticity of the toner at which stacking of the sheets did not occur was $10^7$ Pa. Therefore, $T(10^7)\geq75$ degrees C. should be satisfied. Preferably, $T(10^7)$ is 76 degrees C. or higher. When $T(10^7)$ falls below 75 degrees C., the image immediately after fixing of the toner is sticky and the sheets may stick together when stacked. This is undesirable particularly when a high printing speed is demanded.

Therefore, as described above, both G'(50)/G'(80) and $T(10^7)$ should be high. However, if a large amount of crystalline polyester is used to adjust G'(50)/G'(80) to be in the above-described range, it is difficult to satisfy $T(10^7)\geq75$ degrees C. Thus, it is preferable to control physical properties of the binder resin. It is difficult to make G'(50)/G'(80) to be in the above-described range only by changing the glass transition temperature or molecular weight of the binder resin. It can be understood that the relation (1), i.e., $3.0\times10^2\leq G'(50)/G'(80)$, and the relation (2), i.e., $T(10^7)\geq75$ degrees C., cannot be achieved by the conventional technologies.

Binder Resin

The composition of the polyester may be determined taking into consideration the compatibility with colorants and release agents such as wax (to be described later). For example, the polyester may be obtained by a polycondensation reaction between a diol component and a dicarboxylic acid component or a ring-opening polymerization reaction of a cyclic ester monomer.

Diol Component

The diol component is not particularly limited and can be suitably selected to suit to a particular application. Specific examples thereof include, but are not limited to: aliphatic diols such as ethylene glycol, 1,2-propylene glycol, 1,3-propylene glycol, 1,4-butanediol, 2-methyl-1,3-propanediol, 1,5-pentanediol, 3-methyl-1,5-pentanediol, 1,6-hexanediol, 1,8-octanediol, 1,10-decanediol, and 1,12-dodecanediol; oxyalkylene-group-containing diols such as diethylene glycol, triethylene glycol, dipropylene glycol, polyethylene glycol, polypropylene glycol, and polytetramethylene glycol; alicyclic diols such as 1,4-cyclohexanedimethanol and hydrogenated bisphenol A; alkylene oxide (e.g., ethylene oxide, propylene oxide, and butylene oxide) adducts of alicyclic diols; bisphenols such as bisphenol A, bisphenol F, and bisphenol S; and alkylene oxide (e.g., ethylene oxide, propylene oxide, and butylene oxide) adducts of bisphenols. Among these, aliphatic diols having 4 to 12 carbon atoms are preferred.

Each of these diols can be used alone or in combination with others.

Dicarboxylic Acid Component

The dicarboxylic acid component is not particularly limited and can be suitably selected to suit to a particular application. Examples thereof include, but are not limited to, aliphatic dicarboxylic acids and aromatic dicarboxylic acids.

In addition, anhydrides, lower alkyl (C1-C3) esters, and halides thereof may also be used.

The aliphatic dicarboxylic acids are not particularly limited and can be suitably selected to suit to a particular application. Specific examples thereof include, but are not limited to, succinic acid, adipic acid, sebacic acid, dodecanedioic acid, maleic acid, and fumaric acid.

The aromatic dicarboxylic acids are not particularly limited and can be suitably selected to suit to a particular application. Specific preferred examples thereof include, but are not limited to, aromatic dicarboxylic acids having 8 to 20 carbon atoms.

The aromatic dicarboxylic acids having 8 to 20 carbon atoms are not particularly limited and can be suitably selected to suit to a particular application. Specific examples thereof include, but are not limited to, phthalic acid, isophthalic acid, terephthalic acid, and naphthalene dicarboxylic acid.

Among these, aliphatic dicarboxylic acids having 4 to 12 carbon atoms are preferred.

Each of these dicarboxylic acids can be used alone or in combination with others.

Cyclic Ester Monomer

Examples of the cyclic ester monomer include, but are not limited to, lactic acid enantiomers, 2-hydroxybutanoic acid enantiomers, 2-hydroxypentanoic acid enantiomers, 2-hydroxyhexanoic acid enantiomers, 2-hydroxyheptanoic acid enantiomers, 2-hydroxyoctanoic acid enantiomers, 2-hydroxynonanoic acid enantiomers, 2-hydroxydecanoic acid enantiomers, 2-hydroxyundecanoic acid enantiomers, and 2-hydroxydodecanoic acid enantiomers. Among these, lactic acid enantiomers are particularly preferred for reactivity or availability. These cyclic dimers can be used alone or in combination with others.

Examples of the cyclic esters further include, but are not limited to, aliphatic lactones such as β-propiolactone, β-butyrolactone, γ-butyrolactone, γ-hexanolactone, γ-octanolactone, δ-valerolactone, δ-hexanolactone, δ-octanolactone, ε-caprolactone, δ-dodecanolactone, α-methyl-γ-butyrolactone, β-methyl-δ-valerolactone, glycolide, and lactide.

For the purpose of controlling melting properties, a branching component and/or a cross-linking component may be included as monomer components. In particular, it is preferable that a thermoreversible covalent bond (a cross-linking point or branching point capable of being adsorbed or desorbed by heat) is introduced. As the branching component or cross-linking component, those utilizing a Diels-Alder reaction (by introducing a functional group capable of performing a Diels-Alder reaction) or the cohesive force of metal ions (by introducing ionic bonds) and those introducing a dynamic covalent bond which generates stable radicals upon division may be used.

A Diels-Alder bond is formed by a cyclization reaction between a conjugated diene and a dienophile or a cyclization reaction between conjugated dienes.

In the present disclosure, the Diels-Alder bond refers to a bond formed by a cyclization reaction between a conjugated diene and a dienophile or a cyclization reaction (Diels-Alder reaction) between conjugated dienes.

Examples of the conjugated diene (cross-linking point or branching point) include, but are not limited to, furan ring, thiophene ring, pyrrole ring, cyclopentadiene ring, 1,3-butadiene, thiophene-1-oxide ring, thiophene-1,1-dioxide ring, cyclopenta-2,2-dihydropyridine ring, 2H thiopyran-1, 1-dioxide ring, cyclohexa-2,4-dienone ring, and pyran-2-one ring.

Examples of the dienophile (elongating agent) include, but are not limited to, vinyl group, acetylene group, allyl group, diazo group, nitro group, and maleimide group. The number of these functional groups in one molecule is two or more on average.

Examples of monomers for introducing the branching point or cross-linking point other than those capable of being adsorbed or desorbed include, but are not limited to, polyfunctional aliphatic alcohols such as trimethylolpropane and pentaerythritol, polyfunctional carboxylic acids such as trimellitic acid, isocyanurate comprising a trimer of hexamethylene diisocyanate, and combinations thereof.

The polyester resin as the binder resin preferably has a glass transition temperature of from 40 to 70 degrees C. It is preferable that the amount of residual monomer oligomers remaining in the polyester resin be as small as possible and the weight average molecular weight of the homopolymer before cross-linking is 10,000 or more. The upper limit of the weight average molecular weight is not limited but is approximately 35,000 for the ease in production.

In the present disclosure, the cross-linking point or branching point in a molecule refers to a site capable of undergoing a cross-linking reaction or branching reaction. Hereinafter, the cross-linking point and the branching point are collectively referred to as "cross-linking point". The cross-linking point is not particularly limited as long as the viscoelasticity of the toner is within the numerical range specified in the present disclosure, but it is preferable that a plurality of cross-linking points be present in the molecular chain. The molar ratio of the cross-linking points to the elongating agent (i.e., cross-linking points/functional groups in the elongating agent) is preferably 2 or more, more preferably 4 or more, such that the elongating agent having a low molecular weight does not remain unreacted and many of the cross-linking points remain.

Preferably, the crystalline polyester resin has a melting point of from 60 to 120 degrees C. for low-temperature fixability. It is preferable that the amount of residual monomer oligomers remaining in the crystalline polyester be as small as possible and the weight average molecular weight of the crystalline polyester is 10,000 or more. The upper limit of the weight average molecular weight is not limited but is approximately 35,000 for the ease in production.

The method of introducing the crystalline polyester resin into the toner is not particularly limited and can be suitably selected to suit to a particular application. Generally, the crystalline polyester resin may be introduced into the toner in the state of a liquid dispersion that is prepared by mechanically crushing and dispersing the crystalline polyester resin by a bead mill or in the state of a master batch that is prepared by kneading the crystalline polyester resin with another binder resin comprising an amorphous resin.

Other Components

Examples of the other components include, but are not limited to, a colorant, a release agent, a charge controlling agent, and an external additive.

Colorant

The colorant is not particularly limited and can be suitably selected to suit to a particular application. Examples thereof include, but are not limited to, pigments.

Specific examples of the pigments include, but are not limited to, black pigments, yellow pigments, magenta pigments, and cyan pigments. Preferably, the toner includes at least one selected from yellow pigments, magenta pigments, and cyan pigments.

The black pigments may be used for black toner. Specific examples of the black pigments include, but are not limited to, carbon black, copper oxide, manganese dioxide, aniline black, activated carbon, non-magnetic ferrite, magnetite, nigrosine dye, and iron black.

The yellow pigments may be used for yellow toner. Specific examples of the yellow pigments include, but are not limited to, C.I. Pigment Yellow 74, 93, 97, 109, 128, 151, 154, 155, 166, 168, 180, and 185, Naphthol Yellow S, Hansa Yellow (10G, 5G, G), cadmium yellow, yellow iron oxide, yellow ocher, chrome yellow, titanium yellow, and polyazo yellow.

The magenta pigments may be used for magenta toner. Specific examples of the magenta pigments include, but are not limited to, quinacridone pigments and monoazo pigments such as C.I. Pigment Red 48:2, 57:1, 58:2, 5, 31, 146, 147, 150, 176, 184, and 269. The monoazo pigments and the quinacridone pigments may be used in combination.

The cyan pigments may be used for cyan toner. Specific examples of the cyan pigments include, but are not limited to, Cu-phthalocyanine pigments, Zn-phthalocyanine pigments, and Al-phthalocyanine pigments.

The content of the colorant is not particularly limited and can be suitably selected to suit to a particular application. Preferably, the content of the colorant in 100 parts by mass of the toner is in the range of from 1 to 15 parts by mass, more preferably from 3 to 10 parts by mass. When the content is less than 1 part by mass, the coloring power of the toner may decrease. When the content exceeds 15 parts by mass, the colorant may be poorly dispersed in the toner, causing deterioration of the coloring power and electric properties of the toner.

The colorant can be combined with a resin to be used as a master batch. Specific examples of the resin to be used for the master batch include, but are not limited to, polymers of styrene or derivatives thereof (e.g., polystyrene, poly-p-chlorostyrene, polyvinyl toluene), styrene-based copolymers (e.g., styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl-α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleate copolymer), polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin, and paraffin wax. Each of these can be used alone or in combination with others.

The master batch can be obtained by mixing and kneading the resin and the colorant while applying a high shearing force thereto. To increase the interaction between the colorant and the resin, an organic solvent may be used. More specifically, the maser batch can be obtained by a method called flushing in which an aqueous paste of the colorant is mixed and kneaded with the resin and the organic solvent so that the colorant is transferred to the resin side, followed by removal of the organic solvent and moisture. This method is advantageous in that the resulting wet cake of the colorant can be used as it is without being dried. Preferably, the mixing and kneading is performed by a high shearing dispersing device such as a three roll mill.

Preferably, the colorant (especially a pigment) is present inside the toner. More preferably, the colorant is dispersed inside the toner. In addition, it is preferable that the colorant (especially a pigment) is not present at the surface of the toner.

Release Agent

The release agent is not particularly limited and can be suitably selected to suit to a particular application. Examples thereof include, but are not limited to, carbonyl-group-containing waxes, polyolefin waxes, and long-chain hydrocarbon waxes. Each of these can be used alone or in combination with others. Among these, carbonyl-group-containing waxes are preferred.

Specific examples of the carbonyl-group-containing waxes include, but are not limited to, polyalkanoic acid ester, polyalkanol ester, polyalkanoic acid amide, polyalkyl amide, and dialkyl ketone.

Specific examples of the polyalkanoic acid ester include, but are not limited to, carnauba wax, montan wax, trimethylolpropane tribehenate, pentaerythritol tetrabehenate, pentaerythritol diacetate dibehenate, glycerin tribehenate, and 1,18-octadecanediol distearate.

Specific examples of the polyalkanol ester include, but are not limited to, tristearyl trimellitate and distearyl maleate.

Specific examples of the polyalkanoic acid amide include, but are not limited to, dibehenylamide.

Specific examples of the polyalkyl amide include, but are not limited to, trimellitic acid tristearylamide.

Specific examples of the dialkyl ketone include, but are not limited to, distearyl ketone.

Among these carbonyl-group-containing waxes, polyalkanoic acid ester is particularly preferred.

Specific examples of the polyolefin waxes include, but are not limited to, polyethylene wax and propylene wax. Specific examples of the long-chain hydrocarbon waxes include, but are not limited to, paraffin wax and SASOL wax.

The melting point of the release agent is not particularly limited and can be suitably selected to suit to a particular application, but is preferably from 50 to 100 degrees C., and more preferably from 60 to 90 degrees C. When the melting point is less than 50 degrees C., heat-resistant storage stability of the toner may be adversely affected. When the melting point is in excess of 100 degrees C., the toner may easily cause cold offset when fixed at a low temperature.

The melting point of the release agent can be measured by a differential scanning calorimeter (TA-60WS and DSC-60 available from Shimadzu Corporation) in the following manner.

First, about 5.0 mg of the release agent is put in an aluminum sample container. The container is put on a holder unit and set in an electric furnace. Next, in a nitrogen atmosphere, the temperature is raised from 0 degrees C. to 150 degrees C. at a temperature rising rate of 10 degrees C./min, then lowered from 150 degrees C. to 0 degrees C. at a temperature falling rate of 10 degrees C./min, and raised again to 150 degrees C. at a temperature rising rate of 10 degrees C./min, thus obtaining a DSC curve. The DSC curve is analyzed with analysis program installed in DSC-60 to determine a temperature at which the maximum peak of melting heat is observed in the second heating, and this temperature is identified as the melting point.

Preferably, the melt viscosity of the release agent is from 5 to 100 mPa·sec, more preferably from 5 to 50 mPa·sec, and most preferably from 5 to 20 mPa·sec, at 100 degrees C. When the melt viscosity is less than 5 mPa·sec, releasability may deteriorate. When the melt viscosity is in excess of 100 mPa·sec, hot offset resistance and releasability at low temperatures may deteriorate.

The content of the release agent is not particularly limited and can be suitably selected to suit to a particular application. Preferably, the content of the release agent in 100 parts by mass of the toner is in the range of from 1 to 20 parts by mass, more preferably from 3 to 10 parts by mass. When the content is less than 1 part by mass, hot offset resistance may deteriorate. When the content exceeds 20 parts by mass, heat-resistant storage stability, chargeability, transferability, and resistance to stress may deteriorate.

Charge Controlling Agent

The charge controlling agent is not particularly limited and can be suitably selected to suit to a particular application. Examples thereof include, but are not limited to, nigrosine dyes, triphenylmethane dyes, chromium-containing metal complex dyes, chelate pigments of molybdic acid, Rhodamine dyes, alkoxyamines, quaternary ammonium salts (including fluorine-modified quaternary ammonium salts), alkylamides, phosphorus and phosphorus-containing compounds, tungsten and tungsten-containing compounds, fluorine activators, metal salts of salicylic acid, and metal salts of salicylic acid derivatives. Specific examples of commercially-available products thereof include, but are not limited to: BONTRON 03 (nigrosine dye), BONTRON P-51 (quaternary ammonium salt), BONTRON S-34 (metal-containing azo dye), BONTRON E-82 (metal complex of oxynaphthoic acid), BONTRON E-84 (metal complex of salicylic acid), and BONTRON E-89 (phenolic condensation product), each available from Orient Chemical Industries Co., Ltd.; TP-302 and TP-415 (molybdenum complexes of quaternary ammonium salts), each available from Hodogaya Chemical Co., Ltd.; and LRA-901 and LR-147 (boron complex), each available from Japan Carlit Co., Ltd.

The content of the charge controlling agent is not particularly limited and can be suitably selected to suit to a particular application. Preferably, the content of the charge controlling agent in 100 parts by mass of the toner is in the range of from 0.01 to 5 parts by mass, more preferably from 0.02 to 2 parts by mass. When the content is less than 0.01 parts by mass, the initial rising of charge and the charge quantity of the toner may be insufficient, adversely affecting the toner image quality. When the content is in excess of 5 parts by mass, chargeability of the toner becomes so large that the electrostatic force between the toner and a developing roller is increased and fluidity of the developer and image density are lowered.

External Additive

The external additive is not particularly limited and can be suitably selected to suit to a particular application. Examples thereof include, but are not limited to, silica, metal salts of fatty acids, metal oxides, hydrophobized titanium oxides, and fluoropolymers.

Specific examples of the metal salts of fatty acids include, but are not limited to, zinc stearate and aluminum stearate.

Specific examples of the metal oxides include, but are not limited to, titanium oxide, aluminum oxide, tin oxide, and antimony oxide.

Specific examples of commercially-available products of silica include, but are not limited to, R972, R974, RX200, RY200, R202, R805, and R812 (available from Nippon Aerosil Co., Ltd.).

Specific examples of commercially-available products of titanium oxide include, but are not limited to, P-25 (available from Nippon Aerosil Co., Ltd.); STT-30 and STT-65C-S (available from Titan Kogyo, Ltd.); TAF-140 (available from Fuji Titanium Industry Co., Ltd.); and MT-150W, MT-500B, MT-600B, and MT-150A (available from TAYCA Corporation).

Specific examples of commercially-available products of hydrophobized titanium oxide include, but are not limited to, T-805 (available from Nippon Aerosil Co., Ltd.); STT-30A and STT-65S-S (available from Titan Kogyo, Ltd.); TAF-500T and TAF-1500T (available from Fuji Titanium Industry Co., Ltd.); MT-100S and MT-100T (available from TAYCA Corporation); and IT-S (available from Ishihara Sangyo Kaisha, Ltd.).

The hydrophobizing treatment can be performed by treating hydrophilic particles with a silane coupling agent such as methyl trimethoxysilane, methyl triethoxysilane, and octyl trimethoxysilane.

The content of the external additive is not particularly limited and can be suitably selected to suit to a particular application. Preferably, the content of the external additive in 100 parts by mass of the toner is in the range of from 0.1 to 5 parts by mass, more preferably from 0.3 to 3 parts by mass.

The average particle diameter of the primary particles of the external additive is not particularly limited and can be suitably selected to suit to a particular application, but is preferably 100 nm or less, and more preferably from 3 to 70 nm. When the average particle diameter is less than 3 nm, the external additive may be embedded in the toner and its function may not be effectively exhibited. When the average particle diameter exceeds 100 nm, the external additive may unevenly make flaws on the surface of a photoconductor.

Hereinafter, the procedures and conditions for various measurements are described.

Storage Elastic Modulus G'

The ratio (G'(50))/G'(80)) of the storage elastic modulus G'(50) at 50 degrees C. to the storage elastic modulus G'(80) at 80 degrees C. of the toner according to an embodiment of the present invention is $3.0\times10^2$ or higher. When the ratio is less than $3.0\times10^2$, the toner may not sufficiently express sharply-melting property, which is a property of rapidly melting in the fixable temperature range, while maintaining heat-resistant storage stability and mechanical durability at normal temperature. Preferably, the upper limit of the ratio is $6.0\times10^2$. $T(10^7)$ during a temperature fall is 75 degrees C. or higher. When $T(10^{7)}$ is less than 75 degrees C., heat-resistant storage stability and reliability (such as blocking prevention) are insufficient.

The storage elastic modulus (G') of the toner may be measured with a rheometer (ARES available from TA Instruments). Specifically, a measurement sample is molded into a pellet having a diameter of 8 mm and a thickness of 1 to 2 mm. The pellet is set between parallel plates having a diameter of 8 mm and stabilized at 40 degrees C. The temperature is then raised to 100 degrees C. at a temperature rising rate of 2.0 degrees C./min under a frequency of 1 Hz (6.28 rad/s) and a strain amount of 0.1% (in strain amount control mode) to measure each storage elastic modulus (G'(50) and G'(80)). After reached 100 degrees C., the temperature is lowered to 30 degrees C. at a temperature falling rate of 10 degrees C./min under a strain amount of 1.0% (in strain amount control mode) to determine the temperature $T(10^7)$ at which the storage elastic modulus is $10^7$ Pa.

Amount of Heat Absorption by Differential Scanning Calorimetry (DSC) Preferably, the glass transition temperature of the toner in the first temperature rising in differential scanning calorimetry (DSC) is from 40 to 60 degrees C.

The differential scanning calorimetry may be performed as follows.

Using a differential scanning calorimeter (DSC-60 available from Shimadzu Corporation), 5 mg of a sample weighed in an aluminum pan is cooled to 0 degrees C. at a temperature falling rate of 10 degrees C./min, then heated at a temperature rising rate of 10 degrees C./min, to measure the amount of heat absorption within a range of from 0 to 150 degrees C. from an endothermic peak. In some cases, it may be difficult to distinguish the endothermic peak derived from the crystalline polyester resin from the endothermic peak derived from a wax. To solve this problem, the wax may be extracted from the toner in advance by the method described below to isolate the endothermic peak derived from the crystalline polyester resin.

Particle Diameter of Toner

The volume average particle diameter (Dv) of the toner according to an embodiment of the present invention is preferably from 3 to 8 μm. When the volume average particle diameter is from 3 to 8 μm, the following undesired phenomena can be prevented.

- In the case of a two-component developer, the toner fuses to the surface of a carrier during long-term stirring in a developing device, which reduces charging ability of the carrier.
- In the case of a one-component developer, the toner easily forms its film on a developing roller or fuses to a toner layer thinning member such as a blade.
- Fluctuation of toner particle diameter increases through consumption and supply of the toner in the developer, which makes it difficult to obtain high-resolution high-quality images.

The ratio (Dv/Dn) of the volume average particle diameter (Dv) to the number average particle diameter (Dn) of the toner is preferably from 1.00 to 1.25.

When the ratio (Dv/Dn) of the volume average particle diameter to the number average particle diameter is from 1.00 to 1.25, the following undesired phenomena can be prevented.

- In the case of a two-component developer, the toner fuses to the surface of a carrier during long-term stirring in a developing device, which reduces charging ability of the carrier and cleanability.
- In the case of a one-component developer, the toner easily forms its film on a developing roller or fuses to a toner layer thinning member such as a blade.
- When the ratio (Dv/Dn) is in excess of 1.25, fluctuation of toner particle diameter increases through consumption and supply of the toner in the developer, which makes it difficult to obtain high-resolution high-quality images.

The volume average particle diameter (Dv) and the number average particle diameter (Dn) can be measured by a Coulter counter method. Examples of measuring instruments include, but are not limited to, COULTER COUNTER TA-11 and COULTER MULTISIZER 11 (both manufactured by Beckman Coulter, Inc.).

The measurement method is as follows.

First, 0.1 to 5 mL of a surfactant (preferably an alkylbenzene sulfonate), as a dispersant, is added to 100 to 150 mL of an electrolyte solution. Here, the electrolyte solution is an about 1% by mass NaCl aqueous solution prepared with the first grade sodium chloride, such as ISOTON-II (available from Beckman Coulter, Inc.). A sample in an amount of from 2 to 20 mg is then added thereto. The electrolyte solution, in which the sample is suspended, is subjected to a dispersion treatment with an ultrasonic disperser for about 1 to 3 minutes. The electrolyte solution is thereafter subjected to a measurement of the volume and number of toner particles with the above measuring instrument equipped with a 100-μm aperture, to calculate volume and number distributions. The volume average particle diameter (Dv) and number average particle diameter (Dn) of the toner are calculated from the volume and number distributions, respectively, measured above.

Thirteen channels with the following ranges are used for the measurement: not less than 2.00 μm and less than 2.52 μm; not less than 2.52 μm and less than 3.17 μm; not less than 3.17 μm and less than 4.00 μm; not less than 4.00 μm and less than 5.04 μm; not less than 5.04 μm and less than 6.35 μm; not less than 6.35 μm and less than 8.00 μm; not less than 8.00 μm and less than 10.08 μm; not less than 10.08 μm and less than 12.70 μm; not less than 12.70 μm and less than 16.00 μm; not less than 16.00 μm and less than 20.20 μm; not less than 20.20 μm and less than 25.40 μm; not less than 25.40 μm and less than 32.00 μm; and not less than 32.00 μm and less than 40.30 μm. Namely, particles having a particle diameter not less than 2.00 μm and less than 40.30 μm are to be measured.

Method for Manufacturing Toner

The method for manufacturing the toner is not particularly limited and can be suitably selected to suit to a particular application. Examples thereof include, but are not limited to, a wet granulation method and a pulverization method. Specific examples of the wet granulation method include, but are not limited to, a dissolution suspension method and an emulsion aggregation method. The dissolution suspension method and the emulsion aggregation method are preferred because these methods do not have the process of kneading the binder resin, which is free from the problem of molecular cut caused through kneading or the difficulty in uniformly kneading of high-molecular-weight resin with low-molecular-weight resin. The dissolution suspension method is more preferred for uniformity of the binder resin in the toner particles.

Dissolution Suspension Method

The dissolution suspension method includes a process of preparing a toner material phase, a process of preparing an aqueous medium phase, a process of preparing an emulsion or liquid dispersion, and a process of removing an organic solvent, and optionally includes other processes, as necessary.

Process of Preparing Toner Material Phase (Oil Phase)

The process of preparing a toner material phase is not particularly limited and can be suitably selected to suit to a particular application as long as toner materials including at least the binder resin and optionally the colorant and the release agent are dissolved or dispersed in an organic solvent to prepare a solution or liquid dispersion of the toner materials (hereinafter "toner material phase" or "oil phase").

The organic solvent is not particularly limited and can be suitably selected to suit to a particular application. Preferably, the organic solvent is a volatile solvent having a boiling point of less than 150 degrees C., which is easily removable. Specific examples of the organic solvent include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. Among these solvents, ethyl acetate, toluene, xylene, benzene, methylene chloride, 1,2-dichloroethane, chloroform, and carbon tetrachloride are preferred, and ethyl acetate is most preferred.

Each of these can be used alone or in combination with others.

The amount of the organic solvent to be used is not particularly limited and can be suitably selected to suit to a particular application, but is preferably 300 parts by mass or less, more preferably 100 parts by mass or less, and most preferably from 25 to 70 parts by mass, based on 100 parts by mass of the toner materials.

Process of Preparing Aqueous Medium Phase (Aqueous Phase) The process of preparing an aqueous medium phase is not particularly limited and can be suitably selected to suit to a particular application as long as an aqueous medium phase is prepared. In this process, it is preferable that an aqueous medium phase is prepared by incorporating fine resin particles in an aqueous medium.

The aqueous medium is not particularly limited and can be suitably selected to suit to a particular application. Specific examples of the aqueous medium include, but are not limited to, water, a water-miscible solvent, and a mixture thereof. Among these aqueous media, water is particularly preferable.

The water-miscible solvent is not particularly limited and can be suitably selected to suit to a particular application as long as it is miscible with water. Specific examples thereof include, but are not limited to, an alcohol, dimethylformamide, tetrahydrofuran, a cellosolve, and a lower ketone.

Specific examples of the alcohol include, but are not limited to, methanol, isopropanol, and ethylene glycol.

Specific examples of the lower ketone include, but are not limited to, acetone and methyl ethyl ketone.

Each of these can be used alone or in combination with others.

The aqueous medium phase may be prepared by dispersing the fine resin particles in the aqueous medium in the presence of a surfactant. The reason for adding the surfactant and the fine resin particles in the aqueous medium is to improve dispersibility of the toner materials.

The amounts of the surfactant and the fine resin particles to be added to the aqueous medium are not particularly limited and can be suitably selected to suit to a particular application, but are preferably from 0.5% to 10% by mass based on the aqueous medium.

The surfactant is not particularly limited and can be suitably selected to suit to a particular application. Specific examples of the surfactant include, but are not limited to, anionic surfactants, cationic surfactants, and ampholytic surfactants.

Specific examples of the anionic surfactants include, but are not limited to, fatty acid salts, alkyl sulfate, alkyl aryl sulfonate, alkyl diaryl ether disulfonate, dialkyl sulfosuccinate, alkyl phosphate, naphthalene sulfonic acid formalin condensate, polyoxyethylene alkyl phosphate, and glyceryl borate fatty acid ester.

The fine resin particles are not limited in the type of resin as long as an aqueous dispersion thereof is obtainable. Usable resins include both thermoplastic resins and thermosetting resins. Specific examples of resins usable for the fine resin particles include, but are not limited to, vinyl resin, polyurethane resin, epoxy resin, polyester resin, polyamide resin, polyimide resin, silicone resin, phenol resin, melamine resin, urea resin, aniline resin, ionomer resin, and polycarbonate resin. Each of these can be used alone or in combination with others.

Among these resins, vinyl resin, polyurethane resin, epoxy resin, polyester resin, and combinations thereof are preferred because an aqueous dispersion of fine spherical particles thereof is easily obtainable.

Specific examples of the vinyl resin include, but are not limited to, homopolymers and copolymers of vinyl monomers, such as styrene-acrylate copolymer, styrene-methacrylate copolymer, styrene-butadiene copolymer, acrylic acid-acrylate copolymer, methacrylic acid-acrylate copolymer, styrene-acrylonitrile copolymer, styrene-maleic anhydride copolymer, styrene-acrylic acid copolymer, and styrene-methacrylic acid copolymer.

The average particle diameter of the fine resin particles is not particularly limited and can be suitably selected to suit to a particular application, but is preferably from 5 to 300 nm, and more preferably from 20 to 200 nm.

In preparing the aqueous medium phase, cellulose can be used as a dispersant. Specific examples of the cellulose include, but are not limited to, methyl cellulose, hydroxyethyl cellulose, hydroxypropyl cellulose, and carboxymethylcellulose sodium.

Process of Preparing Emulsion or Liquid Dispersion

The process of preparing an emulsion or liquid dispersion is not particularly limited and can be suitably selected to suit to a particular application as long as the solution or liquid dispersion of the toner materials (i.e., the toner material phase) is emulsified or dispersed in the aqueous medium phase to prepare an emulsion or liquid dispersion.

The process of emulsification or dispersion is not particularly limited and can be suitably selected to suit to a particular application, and may be performed with a known disperser. Specific examples of the disperser include, but are not limited to, a low-speed shearing disperser and a high-speed shearing disperser.

The amount of the aqueous medium phase to be used is not particularly limited and can be suitably selected to suit to a particular application, but is preferably from 50 to 2,000 parts by mass, more preferably from 100 to 1,000 parts by mass, based on 100 parts by mass of the toner material phase. When the amount used is from 50 to 2,000 parts by mass, the following undesirable phenomena can be prevented.

The dispersion state of the toner material phase is so poor that toner particles having a desired particle size cannot be obtained.

Being uneconomical.

Process of Removing Organic Solvent

The process of removing an organic solvent is not particularly limited and can be suitably selected to suit to a particular application as long as the organic solvent is removed from the emulsion or liquid dispersion to obtain a solvent-free slurry.

The organic solvent can be removed by (1) gradually heating the whole reaction system to completely evaporate the organic solvent from oil droplets in the emulsion or liquid dispersion or (2) spraying the emulsion or liquid dispersion into a dry atmosphere to completely evaporate the organic solvent from oil droplets in the emulsion or liquid dispersion. Upon removal of the organic solvent, toner particles are formed.

Other Processes

The other processes may include, for example, a washing process and a drying process.

Washing Process

The washing process is not particularly limited and can be suitably selected to suit to a particular application as long as the solvent-free slurry is washed with water after the process of removing the organic solvent. Specific examples of the water include, but are not limited to, ion-exchange water.

Drying Process

The drying process is not particularly limited and can be suitably selected to suit to a particular application as long as toner particles obtained in the washing process are dried.

Pulverization Method

The pulverization method is a method for producing mother toner particles through the processes of melt-kneading toner materials including at least the binder resin, pulverizing the kneaded product, and classifying the pulverized product.

In the melt-kneading process, a mixture of the toner materials is melt-kneaded by a melt-kneader. Specific examples of the melt-kneader include, but are not limited to, a single-axis or double-axis continuous kneader and a batch kneader using roll mill. Specific examples of commercially-available products of the melt-kneader include, but are not limited to, TWIN SCREW EXTRUDER KTK from Kobe Steel, Ltd., TWIN SCREW COMPOUNDER TEM from Toshiba Machine Co., Ltd., MIRACLE K.C.K from Asada Iron Works Co., Ltd., TWIN SCREW EXTRUDER PCM from Ikegai Corp, and KOKNEADER from Buss Corporation. Preferably, the melt-kneading process is performed under an appropriate condition such that the molecular chains of the binder resin are not cut. Specifically, the melt-kneading temperature is determined with reference to the softening point of the binder resin. When the melt-kneading temperature is excessively higher than the softening point, molecular chains may be significantly cut. When the melt-kneading temperature is excessively lower than the softening point, toner components may not be well dispersed therein.

In the pulverizing process, the melt-kneaded product is pulverized. Preferably, the kneaded product is first pulverized into coarse particles, and the coarse particles are then pulverized into fine particles. Suitable pulverization methods include a method that collides particles with a collision board in a jet stream; a method that collides particles with each other in a jet stream; and a method that pulverizes particles in a narrow gap formed between a rotor mechanically rotating and a stator.

In the classifying process, the pulverized product is adjusted to have a predetermined particle diameter. In the classifying process, ultrafine particles are removed by means of cyclone separator, decantation, or centrifugal separator.

Developer

A developer according to an embodiment of the present invention contains the toner according to an embodiment of the present invention. The developer may be either a one-component developer or a two-component developer in which the toner is mixed a carrier. To be used for a high-speed printer corresponding to a recent improvement in information processing speed, the two-component developer is more preferred for extending the lifespan of the printer.

In the case of a one-component developer, even when toner supply and toner consumption are repeatedly performed, the particle diameter of the toner fluctuates very little. In addition, neither toner filming on a developing roller nor toner fusing to a layer thickness regulating member (e.g., a blade for forming a thin layer of toner) occurs. Thus, even when the developer is used (stirred) in a developing device for a long period of time, developability and image quality remain good and stable.

In the case of a two-component developer, even when toner supply and toner consumption are repeatedly performed for a long period of time, the particle diameter of the toner fluctuates very little. Thus, even when the developer is stirred in a developing device for a long period of time, developability and image quality remain good and stable. The developer according to an embodiment of the present invention can also be used as a developer for replenishment.

Carrier

The carrier is not particularly limited and can be suitably selected to suit to a particular application. Preferably, the carrier comprises a core material and a resin layer coating the core material.

Core Material

The core material is not particularly limited and can be suitably selected to suit to a particular application as long as it is a magnetic particle. Specific examples thereof include, but are not limited to, ferrite, magnetite, iron, and nickel. With respect to ferrite, considering the attention to environmental applicability that is remarkably increasing recently, manganese ferrite, manganese-magnesium ferrite, manganese-strontium ferrite, manganese-magnesium-strontium ferrite, and lithium ferrite are more preferred rather than copper-zinc ferrite that has been conventionally used.

The resin used for the resin layer is not particularly limited and can be suitably selected to suit to a particular application. Specific examples thereof include, but are not limited to, amino resin, polyvinyl resin, polystyrene resin, halogenated olefin resin, polyester resin, polycarbonate resin, polyethylene resin, polyvinyl fluoride resin, polyvinylidene fluoride resin, polytrifluoroethylene resin, polyhexafluoropropylene resin, copolymer of vinylidene fluoride with an acrylic monomer, copolymer of vinylidene fluoride with vinyl fluoride, fluoroterpolymer (e.g., terpolymer of tetrafluoroethylene, vinylidene fluoride, and non-fluoride monomer), and silicone resin. Each of these can be used alone or in combination with others.

The silicone resin is not particularly limited and can be suitably selected to suit to a particular application. Specific examples thereof include, but are not limited to: a straight silicone resin consisting of organosiloxane bonds only; and a modified silicone resin modified with alkyd resin, polyester resin, epoxy resin, acrylic resin, or urethane resin.

Commercially-available products of the silicone resin can also be used.

Specific examples of the straight silicone resin include, but are not limited to: KR271, KR255, and KR152 (available from Shin-Etsu Chemical Co., Ltd.); and SR2400, SR2406, and SR2410 (available from Dow Corning Toray Co., Ltd.).

Specific examples of the modified silicone resin include, but are not limited to: KR-206 (alkyd-modified silicone resin), KR-5208 (acrylic-modified silicone resin), ES-1001N (epoxy-modified silicone resin), and KR-305 (urethane-modified silicone resin), each available from Shin-Etsu Chemical Co., Ltd.; and SR2115 (epoxy-modified silicone resin) and SR2110 (alkyd-modified silicone resin), each available from Dow Corning Toray Co., Ltd.

The silicone resin may be used alone or in combination with a cross-linkable component and/or a charge amount controlling agent.

Preferably, the proportion of components forming the resin layer in the carrier is from 0.01% to 5.0% by mass. When the proportion is from 0.01 to 5.0% by mass, the following undesirable phenomena can be prevented.

- The resin layer cannot be uniformly formed on the surface of the core material.
- The resin layer becomes so thick that coalescence of carrier particles occurs without forming uniform carrier particles.

The amount of the toner contained in the two-component developer is not particularly limited and can be suitably selected to suit to a particular application. Preferably, the amount of the toner in 100 parts by mass of the carrier is from 2.0 to 12.0 parts by mass, more preferably from 2.5 to 10.0 parts by mass.

Toner Accommodating Unit

In the present disclosure, a toner accommodating unit refers to a unit having a function of accommodating toner and accommodating the toner. The toner accommodating unit may be in the form of, for example, a toner container, a developing device, or a process cartridge. The toner container refers to a container containing the toner.

The developing device refers to a device that accommodates toner and is configured to develop an electrostatic latent image into a toner image with the toner. The process cartridge refers to a combined body of an electrostatic latent image bearer (also referred to as an image bearer) with a developing unit accommodating the toner, detachably mountable on an image forming apparatus. The process cartridge may further include at least one selected from a charger, an irradiator, and a cleaner.

An image forming apparatus in which the toner accommodating unit is installed can reliably form high-quality high-definition images for an extended period of time, utilizing the above-described toner that provides both low-temperature fixability and heat-resistant storage stability.

Image Forming Apparatus and Image Forming Method

An image forming apparatus according to an embodiment of the present invention includes at least an electrostatic latent image bearer, an electrostatic latent image forming device, and a developing device, and optionally other devices.

An image forming method according to an embodiment of the present invention includes at least an electrostatic latent image forming process and a developing process, and optionally other processes.

The image forming method is preferably performed by the image forming apparatus. The electrostatic latent image forming process is preferably performed by the electrostatic latent image forming device. The developing process is preferably performed by the developing device. Other optional processes are preferably performed by other optional devices.

More preferably, the image forming apparatus includes: an electrostatic latent image bearer; an electrostatic latent image forming device configured to form an electrostatic latent image on the electrostatic latent image bearer; a developing device containing the above-described toner, configured to develop the electrostatic latent image formed on the electrostatic latent image bearer with the toner to form a toner image; a transfer device configured to transfer the toner image formed on the electrostatic latent image bearer onto a surface of a recording medium; and a fixing device configured to fix the toner image on the surface of the recording medium.

More preferably, the image forming method includes: an electrostatic latent image forming process in which an electrostatic latent image is formed on an electrostatic latent image bearer; a developing process in which the electrostatic latent image formed on the electrostatic latent image bearer is developed with the above-described toner to form a toner image; a transfer process in which the toner image formed on the electrostatic latent image bearer is transferred onto a surface of a recording medium; and a fixing process in which the toner image is fixed on the surface of the recording medium.

In the developing device and the developing process, the above-described toner is used. Preferably, the toner image is formed with a developer containing the above-described toner and other components such as a carrier.

Electrostatic Latent Image Bearer

The electrostatic latent image bearer (also referred to as "photoconductor") is not limited in material, structure, and size, and can be appropriately selected from known materials. Specific examples of the materials include, but are not limited to, inorganic photoconductors such as amorphous silicon and selenium, and organic photoconductors such as polysilane and phthalopolymethine.

Electrostatic Latent Image Forming Device

The electrostatic latent image forming device is not particularly limited and can be suitably selected to suit to a particular application as long as it is capable of forming an electrostatic latent image on the electrostatic latent image bearer. For example, the electrostatic latent image forming device may include a charger to uniformly charge a surface of the electrostatic latent image bearer and an irradiator to irradiate the surface of the electrostatic latent image bearer with light containing image information.

Developing Device

The developing device is not particularly limited and can be suitably selected to suit to a particular application, as long as it stores a toner and configured to develop the electrostatic latent image formed on the electrostatic latent image bearer into a visible image with the toner.

Other Devices

Examples of the other optional devices include, but are not limited to, a transfer device, a fixing device, a cleaner, a neutralizer, a recycler, and a controller.

Preferably, the image forming apparatus according to an embodiment of the present invention has no lubricant application device. The lubricant application device here refers to a device that applies a lubricant to a photoconductor.

The lubricant is applied to the surface of the photoconductor. Examples of the lubricant include, but are not limited to, zinc stearate.

The purposes for applying the lubricant include the following.

- To lower the friction coefficient t to stabilize the behavior of a cleaning blade edge to assist a cleaner.
- To protect the surface of the photoconductor from a charging current when an alternating current voltage is applied to a charging roller.
- To prevent adhesion of toner components to an image bearer and contamination by external additives or paper powder by scraping the lubricant applied to the surface of the image bearer with a cleaning blade.

The lubricant may be applied to the surface of an image bearer with a brush roller. Specifically, an application brush scratches a solid lubricant (block lubricant) and applies the scratched lubricant to the surface of the image bearer.

Generally, in an image forming apparatus free of lubricant application device, the behavior of the cleaning blade edge is unstable to cause cleaning failure. Moreover, the cleaning blade directly contacts the image bearer to increase surface abrasion.

On the other hand, in the image forming apparatus according to an embodiment of the present invention, such a cleaning failure is not likely to occur since the external additive has high irregularity.

FIG. 1 is a schematic view illustrating a first example of the image forming apparatus according to an embodiment of the present invention. An image forming apparatus 100A includes a photoconductor drum 10, a charging roller 20, an irradiator 30, a developing device 40, an intermediate transfer belt 50, a cleaner 60 having a cleaning blade, and a neutralization lamp 70.

The intermediate transfer belt 50 is in the form of an endless belt and is stretched taut by three rollers 51 disposed inside the loop of the endless belt. The intermediate transfer belt 50 is movable in the direction indicated by arrow in FIG. 1. One or two of the three rollers 51 also function(s) as transfer bias roller(s) capable of applying a transfer bias (primary transfer bias) to the intermediate transfer belt 50. A cleaner 90 having a cleaning blade is disposed in the vicinity of the intermediate transfer belt 50. A transfer roller 80 capable of applying a transfer bias (secondary transfer bias) to a transfer sheet 95, for transferring the toner image thereon, is disposed facing the intermediate transfer belt 50. Around the intermediate transfer belt 50, a corona charger 58 that gives charge to the toner image transferred onto the intermediate transfer belt 50 is disposed between a contact portion of the intermediate transfer belt 50 with the photoconductor drum 10 and another contact portion of the intermediate transfer belt 50 with the transfer sheet 95 in the direction of rotation of the intermediate transfer belt 50.

The developing device 40 includes a developing belt 41, and a black developing unit 45K, a yellow developing unit 45Y, a magenta developing unit 45M, and a cyan developing unit 45C each disposed around the developing belt 41. The black, yellow, magenta, and cyan developing units 45K, 45Y, 45M, and 45C include respective developer containers 42K, 42Y, 42M, and 42C, respective developer supplying rollers 43K, 43Y, 43M, and 43C, and respective developing rollers (developer bearers) 44K, 44Y, 44M, and 44C. The developing belt 41 is in the form of an endless belt and stretched taut by multiple belt rollers. The developing belt 41 is movable in the direction indicated by arrow in FIG. 1. A part of the developing belt 41 is in contact with the photoconductor drum 10.

An image forming operation performed by the image forming apparatus 100A is described below. First, the charging roller 20 uniformly charges a surface of the photoconductor drum 10 and the irradiator 30 irradiates the surface of the photoconductor drum 10 with light L to form an electrostatic latent image. The electrostatic latent image formed on the photoconductor drum 10 is developed with toner supplied from the developing device 40 to form a toner image. The toner image formed on the photoconductor drum 10 is primarily transferred onto the intermediate transfer belt 50 by a transfer bias applied from the roller(s) 51 and then secondarily transferred onto the transfer sheet 95 by a transfer bias applied from the transfer roller 80. After the toner image has been transferred onto the intermediate transfer belt 50, the surface of the photoconductor drum 10 is cleaned by removing residual toner particles by the cleaner 60 and then neutralized by the neutralization lamp 70.

Figure 2:
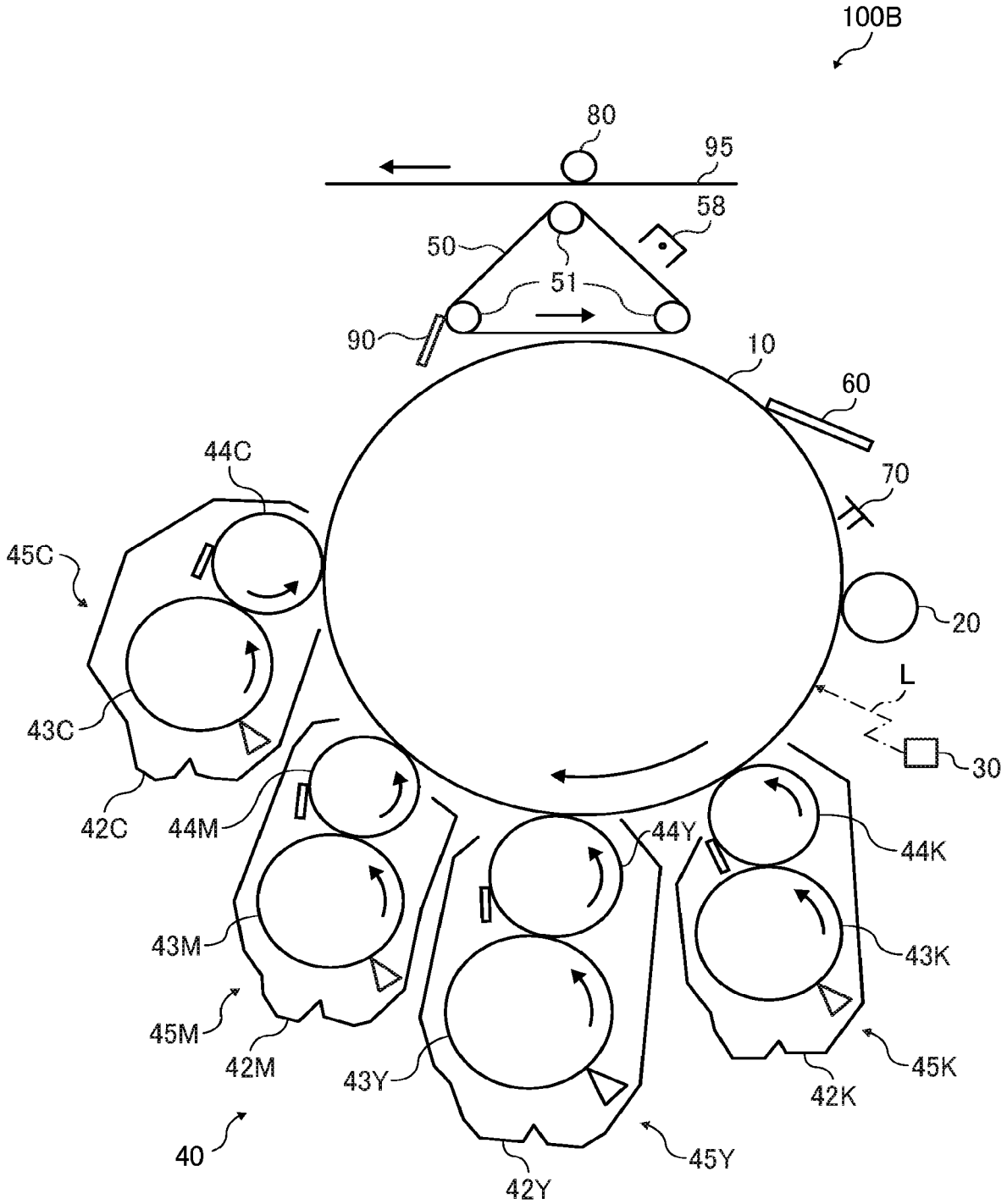
FIG. 2 is a schematic diagram illustrating an image forming apparatus according to an embodiment of the present invention.

FIG. 2 is a schematic view of a second example of the image forming apparatus according to an embodiment of the present invention. An image forming apparatus 100B has a similar configuration to the image forming apparatus 100A except that the developing belt 41 is omitted and the black developing unit 45K, the yellow developing unit 45Y, the magenta developing unit 45M, and the cyan developing unit 45C are disposed facing the circumferential surface of the photoconductor drum 10.

Figure 3:
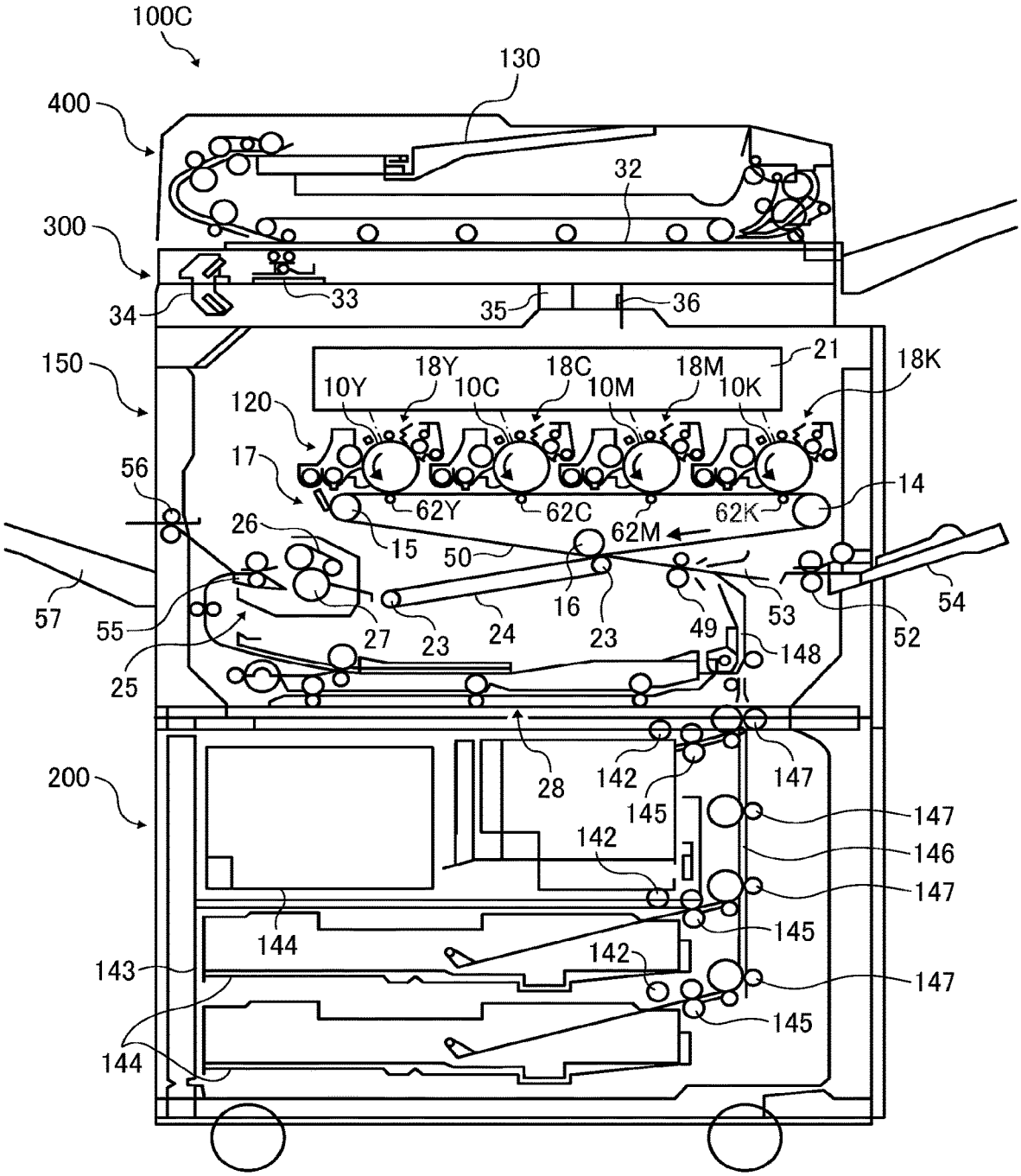
FIG. 3 is a schematic diagram illustrating an image forming apparatus according to an embodiment of the present invention.

FIG. 3 is a schematic view of a third example of the image forming apparatus according to an embodiment of the present invention. An image forming apparatus 100C is a tandem-type full-color image forming apparatus which includes a copier main body 150, a sheet feed table 200, a scanner 300, and an automatic document feeder (ADF) 400.

An intermediate transfer belt 50, disposed at the center of the copier main body 150, is in the form of an endless belt and stretched taut by three rollers 14, 15, and 16. The intermediate transfer belt 50 is movable in the direction indicated by arrow in FIG. 3. In the vicinity of the roller 15, a cleaner 17 having a cleaning blade is disposed that removes residual toner particles remaining on the intermediate transfer belt 50 from which the toner image has been transferred onto a recording sheet. Four image forming units 18Y, 18C, 18M, and 18K for respectively forming yellow, cyan, magenta, and black images are arranged in tandem along the conveyance direction and facing a part of the intermediate transfer belt 50 stretched between the support rollers 14 and 15, thus forming a tandem unit 120.

In the vicinity of the tandem unit 120, an irradiator 21 is disposed. On the opposite side of the tandem unit 120 relative to the intermediate transfer belt 50, a secondary transfer belt 24 is disposed. The secondary transfer belt 24 is in the form of an endless belt stretched taut with a pair of rollers 23. A recording sheet conveyed onto the secondary transfer belt 24 is brought into contact with the intermediate transfer belt 50 at between the rollers 16 and 23.

In the vicinity of the secondary transfer belt 24, a fixing device 25 is disposed. The fixing device 25 includes a fixing belt 26 and a pressing roller 27. The fixing belt 26 is in the form of an endless belt and stretched taut between a pair of rollers. The pressing roller 27 is pressed against the fixing belt 26. In the vicinity of the secondary transfer belt 24 and the fixing device 25, a sheet reversing device 28 is disposed for reversing the recording sheet so that images can be formed on both surfaces of the recording sheet.

A full-color image forming operation performed by the image forming apparatus 100C is described below. First, a document is set on a document table 130 of the automatic document feeder 400. Alternatively, a document is set on a contact glass 32 of the scanner 300 while the automatic document feeder 400 is lifted up, followed by holding down of the automatic document feeder 400.

As a start switch is pressed, in a case in which the document is set on the automatic document feeder 400, the scanner 300 starts driving after the document is moved onto the contact glass 32. On the other hand, in a case in which the document is set on the contact glass 32, the scanner 300 immediately starts driving. A first traveling body 33 equipped with a light source and a second traveling body 34 equipped with a mirror then start traveling. The first traveling body 33 directs light to the document and the second traveling body 34 reflects light reflected from the document toward a reading sensor 36 through an imaging lens 35. Thus, the document is read by the reading sensor 36 and converted into image information of yellow, magenta, cyan, and black.

Figure 4:
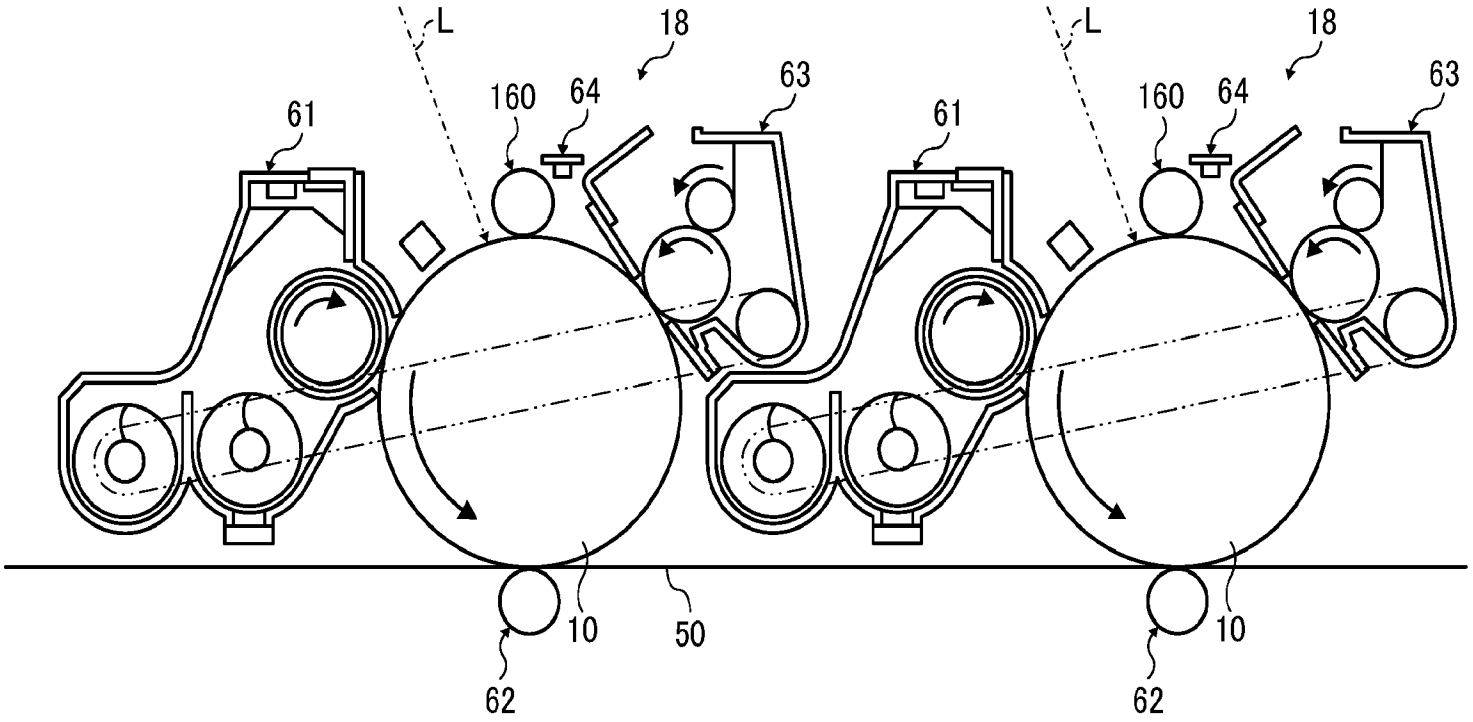
FIG. 4 is a schematic diagram illustrating an image forming apparatus according to an embodiment of the present invention.

The image information of each color is transmitted to the corresponding image forming unit 18Y, 18C, 18M, or 18K to form a toner image of each color. Referring to FIG. 4, each image forming unit 18 includes a photoconductor drum 10, a charging roller 160 to uniformly charge the photoconductor drum 10, a developing device 61 to develop an electrostatic latent image formed on the photoconductor drum 10 into a toner image with a developer of each color, a transfer roller 62 to transfer the toner image onto the intermediate transfer belt 50, a cleaner 63 having a cleaning blade, and a neutralization lamp 64.

The toner images formed in the image forming unit 18Y, 18C, 18M, and 18K are primarily transferred in a successive and overlapping manner onto the intermediate transfer belt 50 stretched and moved by the rollers 14, 15, and 16. Thus, a composite toner image is formed on the intermediate transfer belt 50.

At the same time, in the sheet feed table 200, one of sheet feed rollers 142 starts rotating to feed recording sheets from one of sheet feed cassettes 144 in a sheet bank 143. One of separation rollers 145 separates the recording sheets one by one and feeds them to a sheet feed path 146. Feed rollers 147 feed each sheet to a sheet feed path 148 in the copier main body 150. The sheet is stopped by striking a registration roller 49. Alternatively, recording sheets may be fed from a manual feed tray 54. In this case, a separation roller 52 separates the sheets one by one and feeds it to a manual sheet feeding path 53. The sheet is stopped upon striking the registration roller 49. The registration roller 49 is generally grounded. Alternatively, the registration roller 49 may be applied with a bias for the purpose of removing paper powders from the sheet.

The registration roller 49 starts rotating in synchronization with an entry of the composite toner image formed on the intermediate transfer belt 50 to between the intermediate transfer belt 50 and the secondary transfer belt 24, so that the recording sheet is fed thereto and the composite toner image can be secondarily transferred onto the recording sheet. Residual toner particles remaining on the intermediate transfer belt 50 after the composite toner image has been transferred are removed by the cleaner 17.

The recording sheet having the composite toner image thereon is fed by the secondary transfer belt 24 to the fixing device 25, and the composite toner image is fixed on the recording sheet. A switch claw 55 switches sheet feed paths so that the recording sheet is ejected by an ejection roller 56 and stacked on a sheet ejection tray 57. Alternatively, the switch claw 55 may switch sheet feed paths so that the recording sheet is introduced into the sheet reversing device 28 and gets reversed. After another image is formed on the back side of the recording sheet, the recording sheet is ejected by the ejection roller 56 on the sheet ejection tray 57.

EXAMPLES

Having generally described this invention, further understanding can be obtained by reference to certain specific examples which are provided herein for the purpose of illustration only and are not intended to be limiting. In the following descriptions, "parts" represents "parts by mass" unless otherwise specified.

Production of Amorphous Resin A1

A 5-liter four-neck flask equipped with a nitrogen introducing tube, a dewatering tube, a stirrer, and a thermocouple was charged with propylene glycol (as a diol) and dimethyl terephthalate and dimethyl adipate (as dicarboxylic acids) such that the molar ratio of dimethyl terephthalate to dimethyl adipate became 80/20 and the ratio (OH/COOH) of OH groups to COOH groups became 1.2. These raw materials were allowed to react in the presence of 300 ppm (based on the total mass of the raw materials) of titanium tetraisopropoxide while the produced methanol was allowed to flow out. The temperature was finally raised to 230 degrees C. and the reaction was continued until the acid value of the produced resin became 5 mgKOH/g or less. The reaction was further continued under reduced pressures of from 20 to 30 mmHg until Mw reached 15,000. Subsequently, the reaction temperature was reduced to 180 degrees C. and trimellitic anhydride was added. Thus, an amorphous resin A1 that was an amorphous polyester resin having a carboxylic acid on its terminal was prepared.

Production of Amorphous Resins A2 and A3

Amorphous resins A2 and A3, which were amorphous polyester resins, were prepared in the same manner as the amorphous resin A1 except for changing the dicarboxylic acid and the diol according to the descriptions in Table 1.

Production of Amorphous Resin A4

First, 90 parts of L-lactide and 10 parts of D-lactide (each available from Corbion N.V.) and 2 parts of furfuryl alcohol (polymerization initiator) were put in a four-neck flask and heat-melted at 120 degrees C. for 20 minutes under a nitrogen atmosphere, then 0.2 parts of tin octylate was added thereto and heat-melted at 190 degrees C. for 3 hours. Next, residual lactide and the like were distilled off under reduced pressures to obtain an amorphous resin A4. The number average molecular weight (Mn) was 4,800, and the cross-linking point density was 0.20 mmol/g.

The raw material composition, number average molecular weight (Mn), and cross-linking point density (mmol/g) of the amorphous resins A1 to A4 are shown in Table 1.

Here, the cross-linking point density is a numerical value defined by the following equation. The cross-linking point density is a density of a structural unit that is likely to be cross-linked and is different from the cross-linking density that is a density of the actually cross-linked point.

$$\text{Cross-linking point density (mmol/g)} = \text{Molar ratio of cross-linking point components}/(\Sigma(\text{Molar ratio of each component} \times \text{Molecular weight}) - 64) \times 1000$$

* In the equation, the numeral 64 is the molecular weight of methanol (corresponding to 2 mol) distilled out in the polymerization reaction (transesterification reaction). For a system from which water flows out, the numeral is replaced with 36 (corresponding to 2 mol of water).

TABLE 1

| | | Amorphous Resin | | | |
|---|---|---|---|---|---|
| | | A1 | A2 | A3 | A4 |
| Diol | BisA-EO | 1.0 | 1.0 | 1.0 | |
| Dicarboxylic Acid | Dimethyl Terephthalate | 0.8 | 0.4 | 0.0 | |
| | Dimethyl Adipate | 0.2 | 0.2 | 0.2 | |
| Dicarboxylic Acid (Cross-linking Point) | 2,5-Furandicarboxylic Acid | 0.0 | 0.4 | 0.8 | |
| Lactide | L-Lactide | | | | 0.9 |
| | D-Lactide | | | | 0.1 |
| Number Average Molecular Weight (Mn) | | 4200 | 4400 | 4000 | 4800 |
| Cross-linking Point Density (mmol/g) | | 0 | 0.73 | 1.48 | 0.20 |

In Table 1, "BisA-EO" represents ethylene oxide adduct of bisphenol A.

In Table 1, for the amorphous resins A1 to A3, the numerical values for the diol and the dicarboxylic acids represent molar ratios with respect to the diol. For the amorphous resin A4, the molar ratio between L-lactide and D-lactide is shown. The cross-linking point density is calculated using the ratio among the charged amounts.

Synthesis of Amorphous Resin B

A reaction vessel equipped with a condenser tube, a stirrer, and a nitrogen introducing tube was charged with diol components comprising 100% by mol of 3-methyl-1,5-pentanediol, dicarboxylic acid components comprising 50% by mol of isophthalic acid and 50% by mol of adipic acid, and 1% by mol (based on all monomers) of trimellitic anhydride, along with 1,000 ppm (based on the resin (monomer) components) of titanium tetraisopropoxide, such that the molar ratio (OH/COOH) of OH groups to COOH groups became 1.5.

The vessel contents were heated to 200 degrees C. over a period of about 4 hours, thereafter heated to 230 degrees C. over a period of 2 hours, and the reaction was continued until outflow water was no more produced.

The vessel contents were further allowed to react under reduced pressures of from 10 to 15 mmHg for 5 hours. Thus, an intermediate polyester resin was prepared.

Next, a reaction vessel equipped with a condenser tube, a stirrer, and a nitrogen introducing tube was charged with the intermediate polyester resin and isophorone diisocyanate such that the molar ratio of the intermediate polyester resin to the isophorone diisocyanate became 2.0. The vessel contents were diluted to 50% by mass with ethyl acetate and further allowed to react at 100 degrees C. for 5 hours. Thus, an amorphous resin B was prepared.

The amorphous resin A is an amorphous resin having a thermoreversible covalent bond (cross-linking point), and the amorphous resin B is a resin having no thermoreversible covalent bond. The amorphous resin B is an amorphous resin having a low viscosity and a low Tg and has a role of lowering the lowest fixable temperature.

Preparation of Wax Dispersing Agent

An autoclave equipped with a thermometer and a stirrer was charged with 70 parts of a low-molecular polyethylene (SANWAX 151P available from Sanyo Chemical Industries, Ltd.) having a melting point of 108 degrees C. and 480 parts of xylene and heated to 170 degrees C. The air inside the autoclave was thereafter replaced with nitrogen gas.

Next, a solution in which 805 parts of styrene, 50 parts of acrylonitrile, 45 parts of butyl acrylate, and 36 parts of di-t-butyl peroxide were dissolved in 100 parts of xylene was dropped in the autoclave over a period of 3 hours and the temperature was kept at 170 degrees C. for 30 minutes, followed by solvent removal. Thus, a was dispersing agent was prepared.

Preparation of Resin Particle Dispersion Liquid

In a reaction vessel equipped with a stirrer and a thermometer, 683 parts of water, 11 parts of a sodium salt of a sulfate of ethylene oxide adduct of methacrylic acid (ELEMINOL RS-30 available from Sanyo Chemical Industries, Ltd.), 138 parts of styrene, 138 parts of methacrylic acid, and 1 part of ammonium persulfate were stirred at 400 rpm for 15 minutes, heated to 75 degrees C., and maintained for 5 hours.

Next, 30 parts of a 1% by mass aqueous solution of ammonium persulfate was added to the vessel, and an aging was performed at 75 degrees for 5 hours. Thus, a resin particle dispersion liquid 1 was prepared.

The particle size distribution of the resin particle dispersion liquid 1 was measured by a laser diffraction particle size distribution analyzer LA-920 (available from HORTIBA, Ltd.), and the volume average particle diameter was determined as 0.14 μm.

Preparation of Aqueous Phase 1

An aqueous phase 1 was prepared by mixing 990 parts of water, 83 parts of the resin particle dispersion liquid 1, 37 parts of a 48.5% by mass aqueous solution of dodecyl diphenyl ether sodium disulfonate (ELEMINOL MON-7 available from Sanyo Chemical Industries, Ltd.), and 90 parts of ethyl acetate.

Preparation of Wax Dispersion Liquid

A reaction vessel equipped with a condenser tube, a thermometer, and a stirrer was charged with 130 parts of a paraffin wax (HNP-9 available from Nippon Seiro Co., Ltd., having a melting point of 75 degrees C.), 70 parts of the wax dispersing agent, and 800 parts of ethyl acetate. These materials were heated to 78 degrees C. so that the wax was well dissolved in the ethyl acetate, and then cooled to 30 degrees C. over a period of 1 hour while being stirred. The resulting liquid was subjected to a wet pulverization treatment using an ULTRAVISCOMILL (from Aimex Co., Ltd.) filled with 80% by volume of zirconia beads having a diameter of 0.5 mm, at a liquid feeding speed of 1.0 kg/hour and a disc peripheral speed of 10 m/sec. This dispersing operation was repeated 6 times (6 passes). An amount of ethyl acetate was added to adjust the solid content concentration. Thus, a wax dispersion liquid 1 having a solid content concentration of 20% was prepared.

Preparation of Colorant Master Batch

First, 1,200 parts of water, 540 parts of a carbon black (PRINTEX 35 manufactured by Degussa, having a DBP oil absorption of 42 mL/100 mg and a pH of 9.5), and 1,200 parts of the amorphous resin A1 were mixed with a HEN SCHEL MIXER (manufactured by Mitsui Mining and Smelting Co., Ltd.). The mixture was kneaded with a double roll at 150 degrees C. for 30 minutes, thereafter rolled to cool, and pulverized with a pulverizer. Thus, a colorant master batch was prepared.

Example 1

Preparation of Toner 1

A vessel equipped with a thermometer and a stirrer was charged with 85 parts of the amorphous resin A2 having a cross-linking point density of 0.73 mmol/g, 9 parts of the amorphous resin B 1, and 94 parts of ethyl acetate. The vessel contents were heated to the melting points of the resins or above so that the resins were well dissolved in the ethyl acetate. Further, 25 parts of the wax dispersion liquid and 12 parts of the colorant master batch P1 were added to the vessel, then bis(3-ethyl-5-methyl-4-maleimidephenyl) methane as an elongating agent in an amount of 7 parts (85×0.73/1,000/4×442), which was equivalent to ¼ mol of the cross-linking points, was added thereto.

The vessel contents were stirred by a TK HOMOMIXER (from PRIMIX Corporation) at a revolution of 10,000 rpm at 50 degrees C. so that they were uniformly dissolved or dispersed. Thus, an oil phase 1 was prepared.

Another reaction vessel equipped with a stirrer and a thermometer was charged with 75 parts of ion-exchange water, 3 parts of a 25% liquid dispersion of fine particles of an organic resin (i.e., a copolymer of styrene, methacrylate, butyl acrylate, and sodium salt of sulfate of ethylene oxide adduct of methacrylic acid, available from Sanyo Chemical Industries, Ltd.) for dispersion stability, 1 part of carboxymethylcellulose sodium, 16 parts of a 48.5% aqueous solution of dodecyl diphenyl ether sodium disulfonate (ELEMINOL MON-7 available from Sanyo Chemical Industries, Ltd.), and 5 parts of ethyl acetate. The vessel contents were mixed and stirred to prepare an aqueous phase liquid.

The aqueous phase liquid was mixed with 50 parts of the oil phase 1 using a TK HOMOMIXER (available from PRIMIX Corporation) at a revolution of 12,000 rpm for 1 minute. Thus, an emulsion slurry 1 was prepared.

The emulsion slurry 1 was put in a vessel equipped with a stirrer and a thermometer and subjected to solvent removal for 2 hours at 50 degrees C. Thus, a slurry 1 of mother toner particles was prepared.

The slurry 1 in an amount of 100 parts was subjected to filtration under reduced pressures to obtain a filter cake. The filter cake was subjected to the following washing processes (1) to (4). (1) The filter cake was mixed with 100 parts of ion-exchange water using a TK HOMOMIXER (at a revolution of 6,000 rpm for 5 minutes) and thereafter filtered. (2) The filter cake of (1) was mixed with 100 parts of a 10% aqueous solution of sodium hydroxide using a TK HOMOMIXER (at a revolution of 6,000 rpm for 10 minutes) and thereafter filtered under reduced pressures. (3) The filter cake of (2) was mixed with 100 parts of 10% aqueous solution of hydrochloric acid using a TK HOMOMIXER (at a revolution of 6,000 rpm for 5 minutes) and thereafter filtered. (4) The filter cake of (3) was mixed with 300 parts of ion-exchange water using a TK HOMOMIXER (at a revolution of 6,000 rpm for 5 minutes) and thereafter filtered. This operation was repeated twice.

The resulting filter cake 1 was dried by a circulating air dryer at 45 degrees C. for 48 hours and thereafter sieved with a mesh having an opening of 75 μm. Thus, a mother toner particle 1 was prepared.

The mother toner particle 1 in an amount of 100 parts was mixed with 1.0 part of a hydrophobic silica (HDK-2000 from Wacker Chemie AG) and 0.3 parts of a titanium oxide (MT-150AI from Tayca Corporation) using a HENSCHEL MIXER. Thus, a toner 1 was prepared.

Examples 2 to 4 and Comparative Examples 1 and 2

The procedure in Example 1 was repeated except that the type and proportion of the amorphous resin and the elongating agent used in the process of preparing the oil phase were changed according to the descriptions in Table 2. The measurement results of viscoelasticity of each toner are shown in Table 2 below.

TABLE 2

| Amorphous Resin A | Type | Example 1 A2 | Example 2 A3 | Example 3 A3 | Example 4 A4 | Comparative Example 1 A1 | Comparative Example 2 A1 |
|---|---|---|---|---|---|---|---|
| Amorphous Resin A/ Amorphous Resin B | (—) | 85/9 | 85/9 | 85/9 | 85/9 | 76/18 | 85/9 |
| Elongating Agent (to Cross-linking Points) | (—) | 1/4 | 1/4 | 1/8 | 1/1 | 0 | 0 |
| G'(50)/G'(80) | (—) | 700 | 520 | 400 | 310 | 380 | 200 |
| Staling Resistance ($T(10^7)$) | (deg. C.) | 75 | 78 | 76 | 75 | 64 | 75 |
| Low-temperature Fixability | (—) | A | B | B | B | A | D |

Measurement of Toner Viscoelasticity G'(50), G'(80), and $T(10^7)$

The viscoelasticity (storage elastic modulus) of the above-prepared toners was measured as follows. The measurement results are shown in Table 1.

The storage elastic modulus was measured with a rheometer (ARES available from TA Instruments). The toner was molded into a pellet having a diameter of 8 mm and a thickness of 1 to 2 mm. The pellet was set between parallel plates having a diameter of 8 mm and stabilized at 40 degrees C. The temperature was then raised to 100 degrees C. at a temperature rising rate of 2.0 degrees C./min under a frequency of 1 Hz (6.28 rad/s) and a strain amount of 0.1% (in strain amount control mode) to measure the storage elastic modulus at 50 degrees C. and at 80 degrees C. After reached 100 degrees C., the temperature was lowered to 30 degrees C. at a temperature falling rate of 10 degrees C./min under a strain amount of 1.0% (in strain amount control mode) to determine the temperature $T(10^7)$ at which the storage elastic modulus was $10^7$ Pa.

Low-Temperature Fixability

Low-temperature fixability was evaluated in the following manner.

The developer was put in a unit of IMAGIO MP C4300 (manufactured by Ricoh Co., Ltd.), and a rectangular (2 cm×15 cm) solid image having a toner deposition amount of 0.40 mg/cm$^2$ was formed on sheets of PPC paper TYPE 6000<70W> A4 Machine Direction (manufactured by Ricoh Co., Ltd.).

The surface temperature of the fixing roller was changed, and whether an offset occurred or not was observed at each temperature. Here, the offset is a phenomenon in which a residual image of the solid image is fixed at a position other than the desired position. Low-temperature fixability was evaluated according to the following criteria.

Evaluation Criteria for Low-temperature Fixability

A: lower than 110 degrees C.

B: 110 degrees C. or higher and lower than 120 degrees C.

C: 120 degrees C. or higher and lower than 130 degrees C.

D: 130 degrees C. or higher

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A toner, comprising:

a binder resin;

a colorant; and a release agent, wherein the toner satisfies the following relations (1) and (2):

$$3.0\times10^2 \leq G'(50)/G'(80) \quad (1)$$

$$T(10^7) \geq 75 \text{ degrees C.} \quad (2)$$

where G'(50) represents a storage elastic modulus at 50 degrees C., G'(80) represents the storage elastic modulus at 80 degrees C., and $T(10^7)$ represents a temperature at which the storage elastic modulus is $10^7$ Pa or higher during a temperature fall from 100 degrees C. to 30 degrees C., in a measurement of dynamic viscoelasticity of the toner.

2. The toner according to claim 1, wherein the binder resin comprises a polymer having a thermoreversible covalent bond.

3. The toner according to claim 2, wherein the thermoreversible covalent bond is a Diels-Alder bond.

4. The toner according to claim 3, wherein the Diels-Alder bond is formed by a conjugated diene and a dienophile, wherein:

the conjugated diene comprises at least one functionality selected from the group consisting of a furan ring, a thiophene ring, a pyrrole ring, a cyclopentadiene ring, 1,3-butadiene, a thiophene-1-oxide ring, a thiophene-1,1-dioxide ring, a cyclopenta-2,2-dihydropyridine ring, a 2H thiopyran-1,1-dioxide ring, a cyclohexa-2,4-dienone ring, and a pyran-2-one ring; and the dienophile comprises at least one functionality selected from the group consisting of a vinyl group, an acetylene group, an allyl group, a diazo group, a nitro group, and a maleimide group.

5. The toner according to claim 4, wherein:

the conjugated diene comprises a furan ring; and the dienophile comprises a maleimide group.

6. An image forming apparatus, comprising:

an electrostatic latent image bearer;

an electrostatic latent image forming device;

a developing device containing the toner according to claim 1, configured to develop the electrostatic latent image formed on the electrostatic latent image bearer with the toner to form a toner image;

a transfer device configured to transfer the toner image formed on the electrostatic latent image bearer onto a surface of a recording medium; and a fixing device configured to fix the toner image on the surface of the recording medium.

7. An image forming method, the method comprising:

forming an electrostatic latent image on an electrostatic latent image bearer;

developing the electrostatic latent image formed on the electrostatic latent image bearer with the toner according to claim 1 to form a toner image;

transferring the toner image formed on the electrostatic latent image bearer onto a surface of a recording medium; and fixing the toner image on the surface of the recording medium.

8. A toner accommodating unit, comprising:

a container; and the toner according to claim 1 accommodated in the container.

* * * * *